US005816501A

United States Patent [19]

LoPresti et al.

[11] Patent Number: 5,816,501

[45] Date of Patent: Oct. 6, 1998

[54] DISPOSABLE PAINT CONTAINER LINER AND METHOD

[75] Inventors: Philip B. LoPresti, Chicago, Ill.; Mark E. Charpie, Lambertville, Mich.; Edward T. Feldman, Buffalo Grove, Ill.

[73] Assignee: Ransburg Corporation, Indianapolis, Ind.

[21] Appl. No.: 767,339

[22] Filed: Dec. 16, 1996

[51] Int. Cl.[6] ..... A62C 13/62; B05B 9/04

[52] U.S. Cl. ..... 239/302; 239/320; 239/323; 239/DIG. 14; 220/404; 222/105; 222/183

[58] Field of Search ..... 239/302, 320, 239/323, 328, DIG. 14; 222/105, 183, 386.5; 220/404, 403; 215/11.1

[56] References Cited

U.S. PATENT DOCUMENTS

| | | | |
|---|---|---|---|
| Re. 30,968 | 6/1982 | Grant | 222/111 |
| 2,177,032 | 10/1939 | Baumgardner | 299/92 |
| 3,401,842 | 9/1968 | Morrison | 222/118 |
| 3,432,104 | 3/1969 | Kaltenbach | 239/328 |
| 4,043,510 | 8/1977 | Morris | 239/328 X |
| 5,115,943 | 5/1992 | Coleman | 222/94 |
| 5,143,242 | 9/1992 | Millasich | 220/404 |
| 5,143,294 | 9/1992 | Lintvedt | 239/328 |
| 5,582,350 | 12/1996 | Kosmyna et al. | 239/345 |

*Primary Examiner*—Andres Kashnikow
*Assistant Examiner*—Robin O. Evans
*Attorney, Agent, or Firm*—MacMillan, Sobanski & Todd, LLC

[57] ABSTRACT

A disposable liner for a pressure feed paint cup and a method for using such liner. A lid is removed from the paint cup and a disposable liner bag is inserted into the cup while an open end of the liner bag extends from the open cup end. The open liner bag end is folded over and protects the cup end and paint is poured into the liner bag. A disposable lid is placed over the open cup end and the open liner bag end is folded inwardly over the disposable lid. The paint cup lid is then attached to the paint cup, clamping the liner bag and disposable lid in place. As the paint cup lid is placed on the paint cup, a paint feed tube is pushed through an opening in the disposable lid. Optionally, a ring may be placed in a recess in the disposable lid to retain the folded liner bag end in place while the paint cup lid is attached to the paint cup. After painting, the liner and any remaining paint are disposed of.

7 Claims, 6 Drawing Sheets

DISPOSABLE PAINT CONTAINER LINER AND METHOD

BACKGROUND OF THE INVENTION

When painting with a hand held spray gun, paint may be supplied from a paint cup mounted on the spray gun or from a paint cup which is connected through a hose to the spray gun. When the paint cup is attached to the spray gun, it commonly uses suction for feeding the paint to the gun. As atomization air flows through a nozzle assembly on the spray gun, it creates a reduced pressure which draws the paint from the paint cup to the nozzle where it is discharged and atomized by the air flow. Although some adjustment may be possible between the atomization air flow rate and the fluid flow rate, the maximum fluid flow rate is limited since the suction which creates the fluid flow is a function of the atomization air flow rate. Consequently, the operator's flexibility in using the gun may be limited in certain application. In some spray guns, it is possible to pressurize an attached paint cup in order to provide for positive pressure paint feed to the gun nozzle. This is particularly useful for spraying more viscous materials.

Spray guns with attached paint cups are relatively easy to clean when painting is finished or when the paint color is changed. However, these spray guns have some disadvantages. Since the paint cup is attached to the spray gun during use, the operator will have to hold the relatively heavy weight of the cup and the paint in the cup during spraying. If the painter is painting objects which require a large volume of paint or is painting for a very long time, the added weight may quickly tire the painter and possibly stress the painter's wrist.

An alternative to using an attached paint cup is to use a remote pressurized paint cup which is attached through a hose to deliver paint under pressure to a hand held spray gun. The paint cup may be designed so that it can be either held in the operator's free hand during spraying or hooked on, for example, a ladder step. In these applications, the paint hose may only be about 1 or 2 meters in length. Alternately, a longer paint hose may connect the remote cup to the spray gun and the paint cup may be set on the ground. However, longer hoses require more solvent for cleaning during paint change or upon completion of painting. These spray guns can be more user friendly, since they reduce the weight that the operator must hold during spraying and the paint cup may be sized to hold a larger volume of paint. Also, independent controls over the paint feed pressure in the remote cup and the atomization air flow provide for maximum flexibility in spray finishing applications. One disadvantage with a remote pressurized paint cup is that additional solvent and labor have required for cleaning the paint cup and the connecting paint hose during paint change or when painting is completed.

BRIEF SUMMARY OF THE INVENTION

The invention is directed to a disposable liner for remote paint cups and to a method for using the liner in a paint cup. The paint cup has a lid or cover which is secured to the cup either with a threaded ring which engages complementary threads on a paint cup rim or with a conventional clamping arrangement. The liner includes a disposable bag which initially is inserted into the paint cup with an open end extending from the paint cup. The open end of the liner bag is folded over the upper end of the cup to protect the cup rim and threads from paint during filling. Next, a desired volume of paint is poured into the bag in the paint cup and a disposable lid is placed on the top of the paint cup. The disposable lid fits snugly into the paint cup rim and has a radial flange which extends over the open end of the paint cup rim. The open end of the bag is folded inwardly over the peripheral edge of the disposable lid and the paint cup lid is secured to the paint cup. The disposable lid and the disposable bag are thus clamped between the paint cup and the paint cup lid to prevent paint leakage between the disposable lid and bag. As the paint cup lid is placed on the paint cup, a paint feed tube is pushed through a tight fitting opening in the disposable lid to extend to adjacent a bottom of the bag in the paint cup. Optionally, an insert ring may be positioned in a recess in the disposable lid to hold the open disposable bag end away from threads on the paint cup as the paint cup lid is secured to the paint cup.

The disposable lid includes at least one vent opening for providing an air passage between the paint in the paint cup liner and the space between the disposable lid and the paint cup lid. Thus, when pressurized air is delivered through a passage in the paint cup lid to the interior of the paint cup, the air will flow into the liner to provide pressure feed for delivering the paint to the spray gun.

After painting with the paint in the paint cup is completed, the paint cup lid is removed, withdrawing the paint feed tube from the liner cover. The liner cover has a sufficiently tight fit with the paint feed tube to wipe paint from the exterior of the tube as it is withdrawn from the disposable lid. If desired, air pressure may be applied to the spray gun nozzle to purge any paint remaining in the spray gun and the connecting hose back into the liner so that it can be easily disposed of with the liner. The disposable liner and any remaining paint may be lifted from the paint cup and easily disposed of. The liner may, for example, be placed in a plastic bag which is sealed with a zipper closure for a mess free disposal. Only the paint feed tube on the paint cup lid and the paint passages in the paint feed hose and spray gun need to be cleaned. Optionally, a disposable paint feed tube may be secured to the paint cup lid. The disposable paint feed tube will then remain with the disposable liner and lid when the paint cup lid is removed from the paint cup. The disposable paint cup liner has the benefit of reducing labor, cleaning solvent and disposal costs when cleaning the paint cup for a color change, for other change in the type of paint being sprayed and when painting is completed.

Accordingly, it is an object of the invention to provide a disposable paint cup liner and a method for using the disposable paint cup liner.

Other objects and advantages of the invention will become apparent from the following detailed description of the invention and the accompanying drawings.

DETAILED DESCRIPTION OF THE INVENTION

Figure 1:
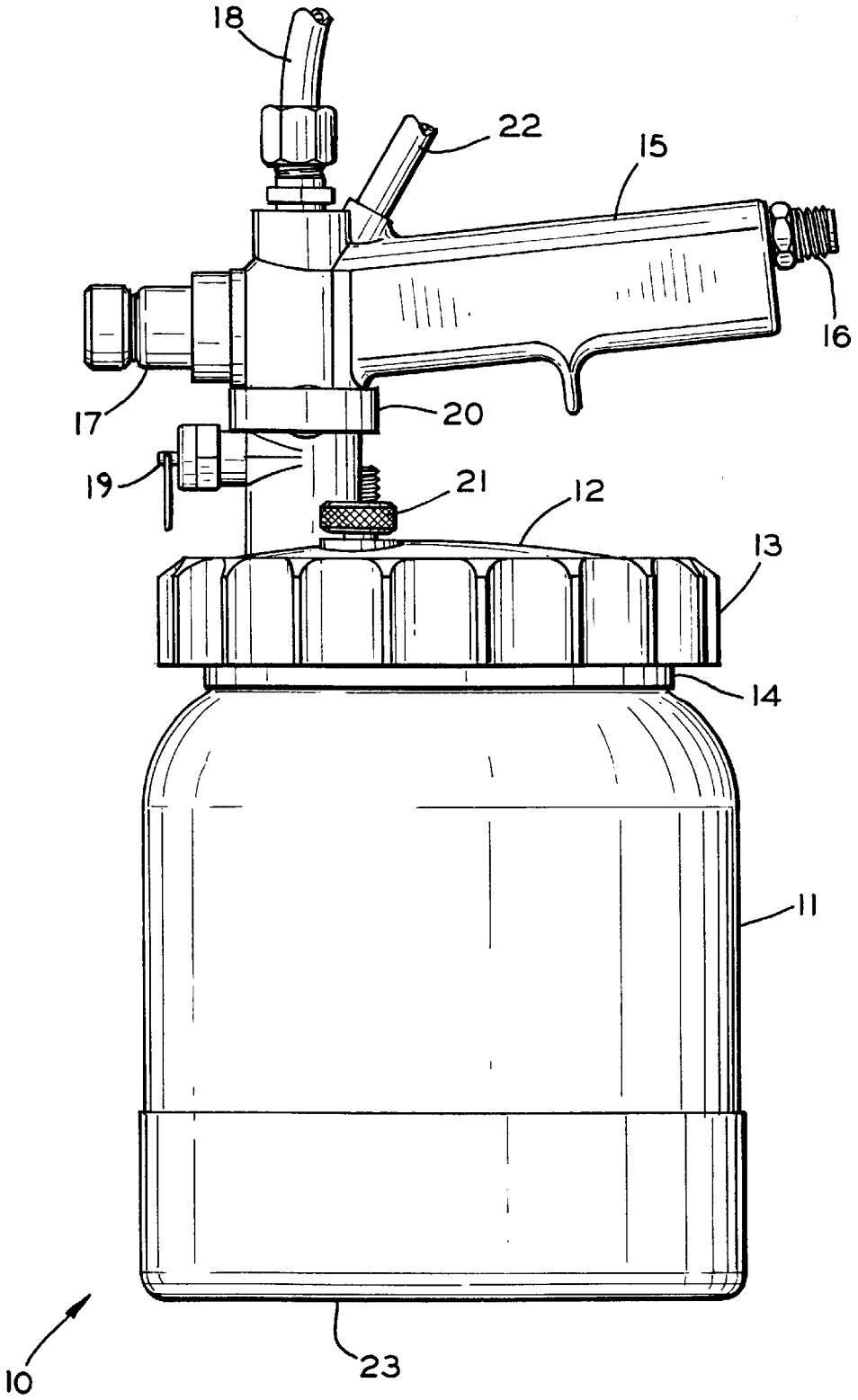
FIG. 1 is a side elevational view of a prior art portable pressurized paint container suitable for use with a disposable liner according to the invention.

Referring first to FIG. 1 of the drawings, a commercially available pressure feed paint cup assembly 10 is illustrated. The paint cup assembly 10 includes a paint cup 11 and a lid 12 which is secured to the paint cup 11 with a retainer ring 13. The retainer ring 13 is internally threaded to engage an externally threaded rim 14 on the paint cup for removably securing the paint cup lid 12 to the paint cup 11. The paint cup assembly 10 may be designed for setting on the floor during use, or for holding in the painter's free hand or for hanging from any available support. In the illustrated paint cup assembly 10, the lid 12 has an integral handle 15 for holding the paint cup assembly 10.

An air hose fitting 16 is mounted on the handle 15 for connection to a conventional source of pressurized air (not shown). Pressurized air flows from the fitting 16 through a manually adjustable pressure setting valve 17 and into the interior of the paint cup 11. The air pressure in the paint cup 11 causes the paint to flow through a paint hose 18 to a conventional hand held spray gun (not shown). The pressurized air passages in the handle 15 also may be connected to an overpressure safety valve 19 and a pressure indicating gauge 20, both of which are downstream from the valve 17. A manual paint cup vent 21 is provided in the lid 12 for venting pressure within the paint cup 11 to facilitate removing the lid 12 from the paint cup 11.

A hook 22 (shown in fragmentary) may be secured to the lid 12 for hanging the paint cup assembly 10 during spraying from any available support, such as a ladder step. Also, the paint cup 11 is provided with a flat bottom 23 to permit standing the paint cup assembly 10 on any available flat surface, such as the floor or a work table.

In order to minimize the amount of solvent required for cleaning during a change in paint or when painting is finished, the paint hose 18 should be only as long as necessary. If the paint cup assembly 10 is to be hand held during painting, the paint hose 18 may only need to be 1 to 2 meters long. If the paint cup is to be set on the floor during use, the paint hose 18 will need to be significantly longer.

According to the invention, a disposable liner is placed in the paint cup during spraying. When spraying with a particular paint is completed, the disposable liner is removed from the paint cup and is discarded. The pressurized air flow to the paint cup 11 may be shut off and the paint cup vent 21 opened to vent the paint cup to the atmosphere prior to removing the lid 12. Optionally, air pressure may be applied to the spray gun nozzle to blow paint from the spray gun and the paint hose 18 back into the disposable liner in the paint cup 11. This paint will then be disposed of with the disposable liner. If desired, the liner and any paint remaining in the liner may be sealed in a plastic bag having a zipper closure for disposal to prevent paint spillage.

Figure 2:
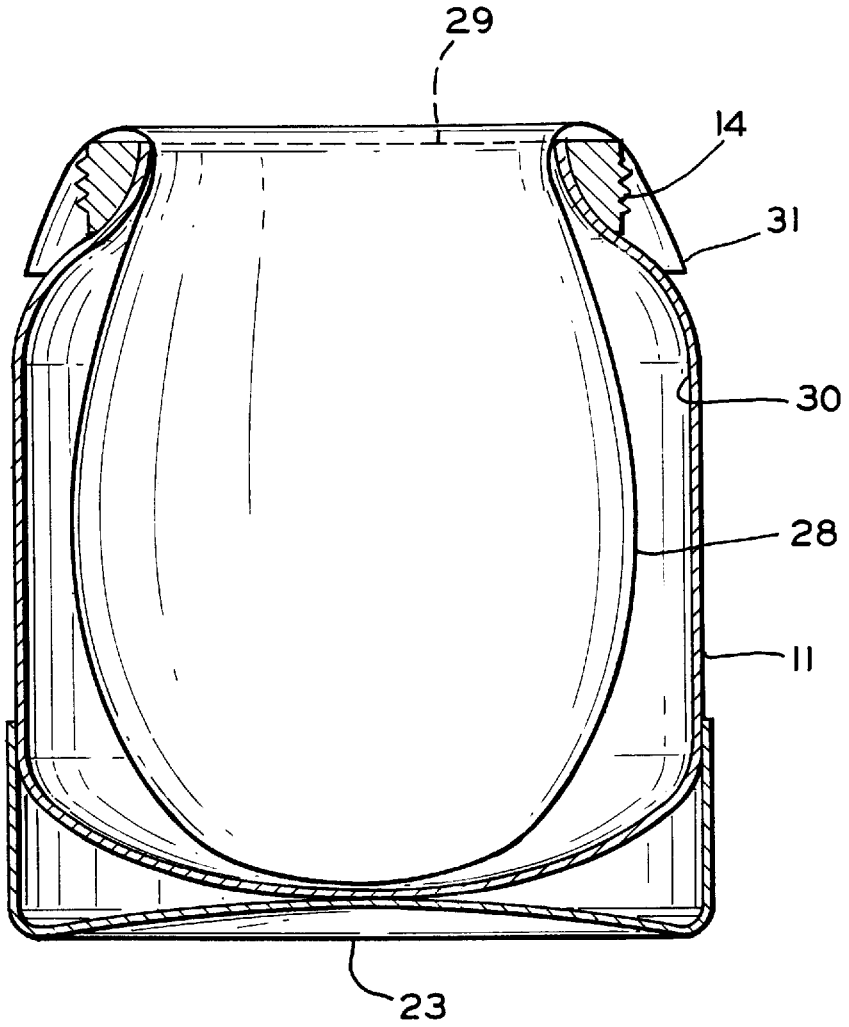
FIG. 2 is a cross sectional view of the lower paint cup portion of the container of FIG. 1 with a liner bag inserted.

The disposable paint cup liner and its use are illustrated in FIGS. 2–6. The disposable paint cup liner includes a disposable bag 28 which is of a thin, flexible solvent tolerant material, such as polyethylene or a high density polyethylene (HDPE). The actual material used for the bag 28 may vary with the particular solvents in the coating material which will be placed in the bag 28. As an initial step, as illustrated in FIG. 2, the bag 28 is inserted through an end opening 29 in the paint cup 11 and into an interior cavity 30 in the paint cup 11. The end opening 29 is defined by the paint cup rim 14. A sufficient portion of the disposable bag 28 is positioned in the cavity 30 so as to permit it to expand to the size of the cavity 30.

Figure 3:
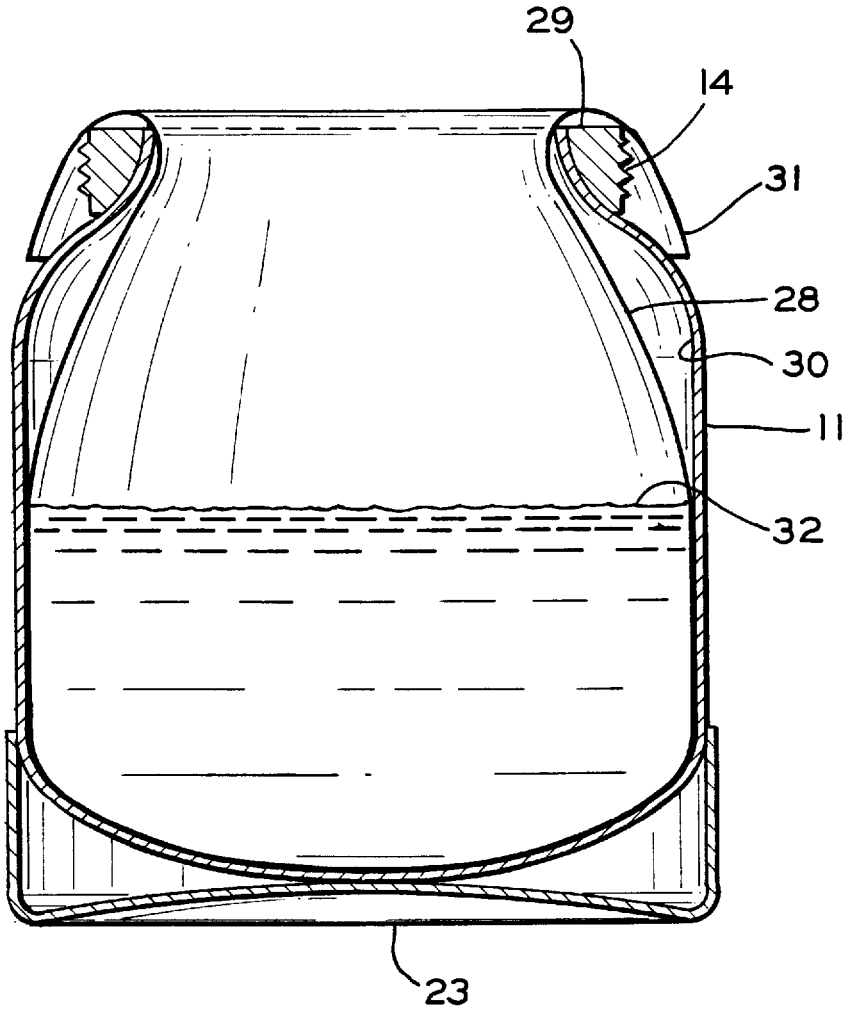
FIG. 3 is a cross sectional view of the paint cup of FIG. 2 with a volume of paint added.

The disposable bag 28 is sufficiently large as to have an open end 31 which extends from the open paint cup end 29. The disposable bag 28 may have a rectangular shape when flattened, or it may be shaped to more closely conform to the shape of the paint cup cavity 30 and the open paint cup end 29. The open bag end 31 is then folded outwardly and downwardly over the paint cup rim 14. In this position, the open bag end 31 protects the paint cup rim 14 from possible contamination with paint when the paint cup 11 is filled. FIG. 3 shows the paint cup 11 and attached disposable bag 28 after a volume of paint 32 has been poured into the disposable bag 28.

Figure 4:
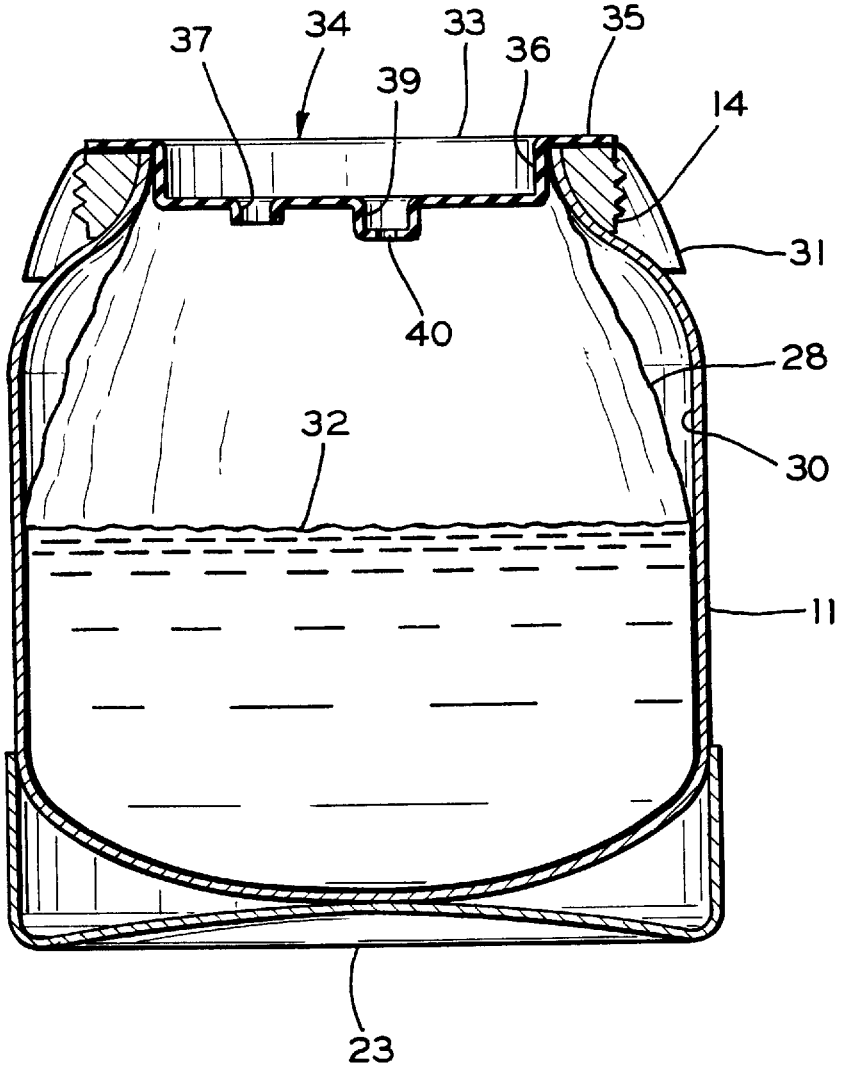
FIG. 4 is a cross sectional view of the paint cup of FIG. 3 with a liner lid positioned on the paint cup.

Referring to FIG. 4, a disposable lid 33 is shown positioned on the paint cup rim 14. The disposable bag 28 and the disposable lid 33 together form the disposable liner 34. The disposable bag 28 extends radially outwardly between the paint cup rim 14 and a radial rim 35 on the disposable lid 33. Preferably, the disposable lid 33 has an annular step or recessed portion 36 which extends slightly into the paint cup cavity 30 and closely engages the interior of the rim 14 for positioning the disposable lid 33 on the rim 14. The illustrated disposable lid 33 has in the recessed portion 36 an opening 37 for passing a paint feed tube 38 (shown only in FIG. 6) and further may have a central recess 39 in which a vent opening 40 is formed. If the vent opening 40 is located at or near the center of the disposable lid 33, the risk of paint leaking through the vent opening 40 is minimized if the paint cup assembly 10 is tipped. However, since the paint cup assembly 10 is not attached to and tipped with a spray gun, the risk of leakage through vents in the disposable lid 33 is minimal. In place of a single central vent opening 40, a plurality of vent openings may be spaced around the disposable lid 33 at a radial distance from the center.

Figure 5:
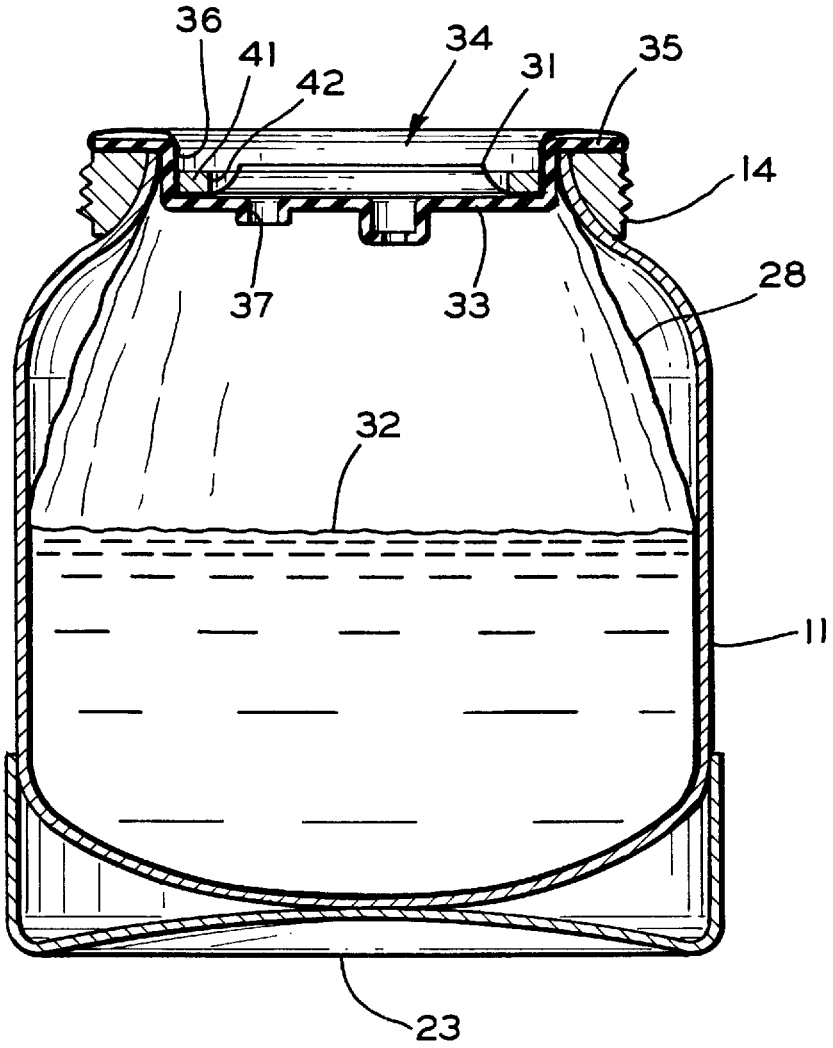
FIG. 5 is a cross sectional view of the paint cup of FIG. 4 showing the liner bag folded over the liner lid and a ring inserted into a recess in the liner lid to hold the open end of the liner bag.

Turning to FIG. 5, the open end 31 of the disposable liner bag 28 is folded inwardly over the disposable lid rim 35. An optional insert ring 41 may be pushed into the recess 36 to hold the open bag end 31 in the inwardly folded position. The insert ring 41 may be circular in cross section or, as shown, may have a generally flat inner surface 42. The flat surface 42 aids in picking up the insert ring 41. It is preferable for the insert ring 41 to have a snug fit and not a press fit in the recessed portion 36 to facilitate inserting and removing the insert ring 41. The insert ring 41 functions to keep the open bag end 31 away from the threads on the paint cup rim 14 when the retainer ring 13 is secured to the threaded paint cup rim 14.

Figure 6:
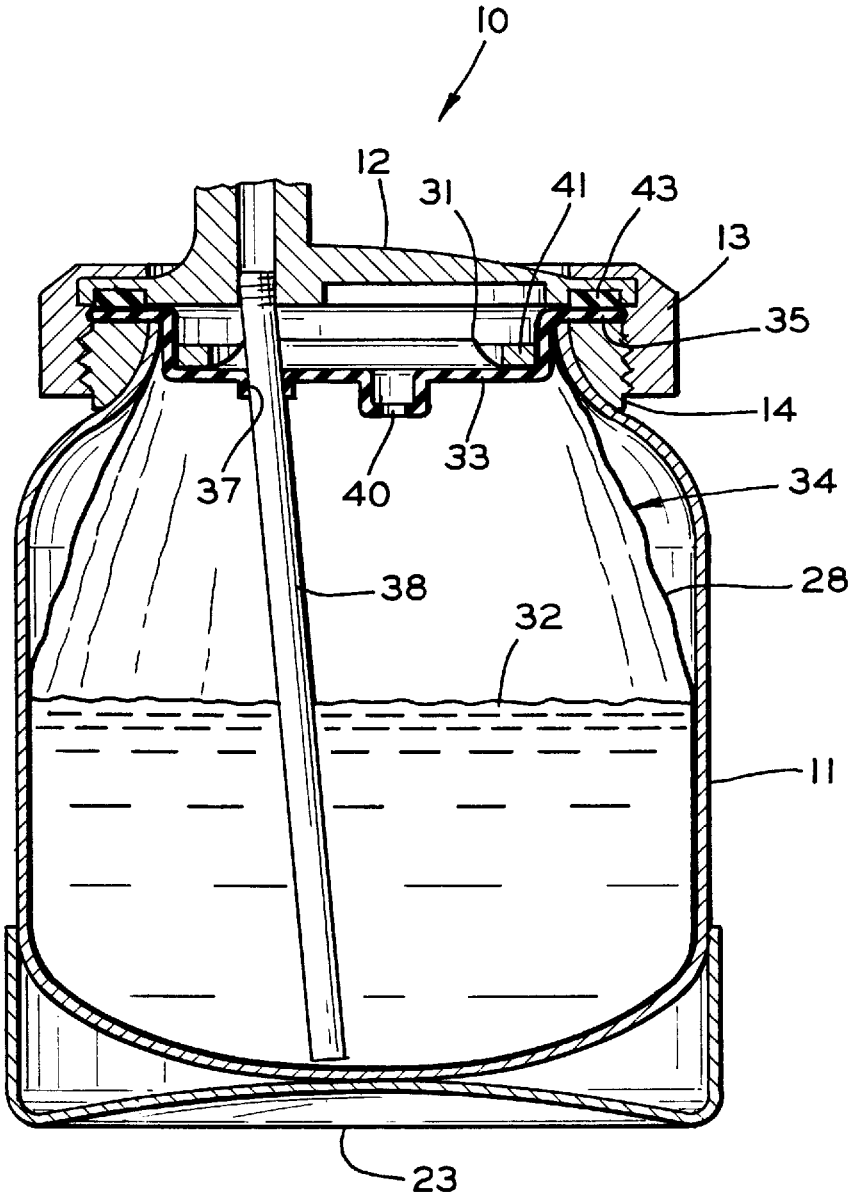
FIG. 6 is a cross sectional view of the paint cup of FIG. 5 with a top assembly, in partial fragmentary, attached to the paint cup.

FIG. 6 shows the paint cup lid 12 secured to the paint cup 11 to complete the paint cup assembly 10. As the paint cup lid 12 is moved towards the paint cup 11, the paint feed tube 38 is pushed through the disposable lid opening 37. Preferably, the fit between the disposable lid opening 37 and the paint feed tube 38 is sufficiently snug to prevent paint leakage therebetween. After the paint cup lid 12 is positioned on the paint cup 11, the retainer ring 13 is secured to the threaded rim 14 to seal the paint cup 11. The open end 31 of the disposable bag 28 is wrapped around the disposable lid rim 35 and is clamped between the paint cup rim 14 and a resilient seal 43 on the paint cup lid 12. Thus, a seal is formed between the disposable bag 28 and the disposable lid 33. As air pressure is delivered through the paint cup lid 12 to the space between the paint cup lid 12 and the disposable lid 33, it is free to flow through the vent opening 40 to force the paint 32 to flow through the paint feed tube 38 to the spray gun.

If the paint cup 11 is emptied during use and additional paint is required, the paint cup lid 12 may be removed from the paint cup 11. As the paint feed tube 38 is withdrawn from the disposable lid opening 37, the exterior surface of the paint feed tube 38 is wiped clean to prevent dripping. By pulling on the free open end 31 of the disposable liner bag 28, the insert ring 41 will pop out of the recess 36. The open bag end 31 is then folded outwardly over the paint cup rim 14, the disposable lid 33 is removed from the paint cup 11 and additional paint 32 is added to the disposable bag 28 in the paint cup 11. The paint cup assembly 10 is then reassembled as described above.

When painting with a particular paint is completed, the paint cup 11 may be vented to atmosphere and pressurized air may be used to force any paint remaining in the spray gun, the paint hose 18 and the paint feed tube 38 back into the disposable bag 28. The paint cup lid 12 is removed from the paint cup 11, withdrawing the paint feed tube 38, and the disposable liner 34 is disposed of. If desired, the disposable liner 34 and any remaining paint may be placed in a plastic bag (not shown) which is sealed with a zipper closure. Optionally, the paint feed tube 38 also may be constructed of an inexpensive material and disposed of with the disposable liner 34. It is only necessary to clean the paint passages in the spray gun, in the paint hose 18 and in the paint cup lid 12. Consequently, the time, labor and solvent required for cleaning is reduced. As a further option, the paint hose 18 and the paint feed tube 38 may be formed to be disposable as a unit with the disposable liner 34.

The paint cup assembly 10 has been described with a retainer ring 13 for securing the lid 12 to the paint cup 11. Other conventional arrangements also may be used for securing the lid 12 to the paint cup 11. For example, the threads on the paint cup rim 14 may be replaced with two or more projecting pins which are engaged by a known clamping mechanism on the lid 12. It will be appreciated that various other modifications and changes may be made to the above described preferred embodiment of a disposable liner for a paint spray gun and of a method for using a disposable liner without departing from the scope of the following claims. Although the invention has been described for use with a paint spray gun, it is equally applicable to use with containers for pressure feeding other types of coating materials to a spray gun.

We claim:

1. A method for using a pressurized liquid coating material container which has a removable container lid which when secured to said container closes an open container end, said lid mounting a paint feed tube which extends through said open container end to adjacent a bottom of said container when said lid is secured to said container, said method comprising the steps of:

a) inserting a disposable liner bag through said open container end into said paint container, said liner bag having an open bag end which extends through said open container end;

b) folding said open bag end over said open container end;

c) filling said liner bag with a predetermined quantity of coating material;

d) placing a disposable lid over said open container end in contact with said folded open bag end;

e) folding said open bag end inwardly over said disposable lid; and f) securing said removable container lid to said container, whereby said liner bag and said disposable lid are clamped between said open container end and said removable container lid.

2. A method for using a pressurized liquid coating material container, as set forth in claim 1, and wherein said container has external threads adjacent said open container end to which said container lid is removably secured, and wherein said open bag end is folded over said threads prior to filling said liner bag to protect said threads from contact with coating material during filing.

3. A method for using a pressurized liquid coating material container, as set forth in claim 2, and wherein said disposable lid has a circular recess, and, after said open bag end is folded inwardly and prior to securing said removable container lid to said container, further including the step of positioning a ring to hold said open bag end in said circular recess to retain said open bag end in its inwardly folded position while said removable container lid is secured to said container.

4. A method for using a pressurized liquid coating material container, as set forth in claim 3, and wherein said disposable lid has an opening adapted to pass said material feed tube while engaging an exterior surface of said material feed tube, and further including the step of pushing said material feed tube through said disposable lid opening as said removable container lid is secured to said container.

5. A method for using a pressurized liquid coating material container, as set forth in claim 1, and wherein said disposable lid has a circular recess, and, after said open bag end is folded inwardly and prior to securing said removable container lid to said container, further including the step of positioning a ring to hold said open bag end in said circular recess to retain said open bag end in its inwardly folded position while said removable container lid is secured to said container.

6. A method for using a pressurized liquid coating material container, as set forth in claim 5, and wherein said disposable lid has an opening adapted to pass said material feed tube while engaging an exterior surface of said material feed tube, and further including the step of pushing said material feed tube through said disposable lid opening as said removable container lid is secured to said container.

7. A disposable liner for a paint container including a paint cup having an open end and a lid adapted to be removably secured to and to close the open paint cup end, said liner comprising a disposable bag adapted to line the paint cup and to have an open end which extends from the open paint cup end, a disposable lid adapted to engage the open paint cup end, said disposable lid having an opening adapted to receive and engage a paint feed tube on the paint cup lid and having at least one vent opening, said disposable lid having a top surface with an annular step, said bag having a sufficiently large size to permit said open bag end to extend outwardly between said lid and the open paint cup end and then inwardly over said lid top and into said annular step, and an insert ring adapted to be inserted into said annular step to retain said open bag end in said annular step.

* * * * *